US010319508B2

(12) United States Patent
Takeda

(10) Patent No.: US 10,319,508 B2
(45) Date of Patent: Jun. 11, 2019

(54) ELECTRONIC COMPONENT

(71) Applicant: MURATA MANUFACTURING CO., LTD., Kyoto-fu (JP)

(72) Inventor: Yasushi Takeda, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 100 days.

(21) Appl. No.: 15/611,123

(22) Filed: Jun. 1, 2017

(65) Prior Publication Data

US 2017/0365396 A1 Dec. 21, 2017

(30) Foreign Application Priority Data

Jun. 16, 2016 (JP) ..... 2016-120230

(51) Int. Cl.

| | |
|---|---|
| ***H01F 5/00*** | (2006.01) |
| ***H01F 27/28*** | (2006.01) |
| ***H01F 27/32*** | (2006.01) |
| ***H01F 17/00*** | (2006.01) |

(52) U.S. Cl.

CPC ..... *H01F 27/2804* (2013.01); *H01F 17/0013* (2013.01); *H01F 27/323* (2013.01); *H01F 2017/004* (2013.01); *H01F 2027/2809* (2013.01)

(58) Field of Classification Search

USPC ..... 336/200, 232, 83

See application file for complete search history.

(56) References Cited

U.S. PATENT DOCUMENTS

| | | | | |
|---|---|---|---|---|
| 6,580,350 | B1 * | 6/2003 | Kobayashi | H01F 17/0013 336/192 |
| 6,643,913 | B2 * | 11/2003 | Uchikoba | H01F 17/0013 29/602.1 |
| 8,912,874 | B2 * | 12/2014 | Otsubo | H01F 17/0013 336/192 |
| 2009/0108958 | A1 * | 4/2009 | Hadano | H03H 7/0115 333/175 |

FOREIGN PATENT DOCUMENTS

| | | |
|---|---|---|
| JP | 2001-044036 A | 2/2001 |
| JP | 2010-183007 A | 8/2010 |
| JP | 2012-204475 A | 10/2012 |

* cited by examiner

*Primary Examiner* — Elvin G Enad
*Assistant Examiner* — Kazi S Hossain
(74) *Attorney, Agent, or Firm* — Studebaker & Brackett PC

(57) ABSTRACT

An electronic component includes a plurality of groups arrayed in a stacking direction, each including a first inductor conductor layer, a second inductor conductor layer, a connection conductor layer and a first insulator layer. In each group, the first insulator layer is provided between a first superposed portion of the first inductor conductor layer and a second superposed portion of the second inductor conductor layer. The connection conductor layer is provided at the same position as the first insulator layer in the stacking direction, and electrically connects the first non-superposed portion and the second non-superposed portion included in the same group to each other. Among two adjacent groups in the stacking direction, a second superposed portion included in a group on another side in the stacking direction and a first superposed portion included in a group on one side in the stacking direction are physically connected to each other.

9 Claims, 26 Drawing Sheets

-- Prior Art --

ELECTRONIC COMPONENT

CROSS REFERENCE TO RELATED APPLICATIONS

This application claims benefit of priority to Japanese Patent Application 2016-120230 filed Jun. 16, 2016, the entire content of which is incorporated herein by reference.

TECHNICAL FIELD

The present disclosure relates to an electronic component, and in particular, relates to an electronic component that includes an inductor.

BACKGROUND

For example, a multilayer inductor disclosed in Japanese Unexamined Patent Application Publication No. 2001-44036 is a known example of an electronic component of the related art. FIG. 9 is an exploded perspective view of a multilayer inductor 500 disclosed in the above-cited patent document.

The multilayer inductor 500 includes a multilayer body 512 and an inductor 511. The multilayer body 512 has a structure obtained by stacking a plurality of ferrite sheets 516 on top of one another. The inductor 511 has a helical shape formed by connecting inner electrodes 518*a*, 518*b* . . . , and 519*a*, 519*b* . . . to one another. The inner electrodes 518*a*, 518*b* . . . , and 519*a*, 519*b* . . . are provided on the ferrite sheets 516, and each have a rectangular shape with a portion cut out therefrom when viewed from above. Thus, the inner electrodes 518*a*, 518*b* . . . , and 519*a*, 519*b* . . . have a shape that winds in the anticlockwise direction and each have the length of approximately one revolution. In addition, the inner electrodes 518*a*, 518*b* . . . , and the inner electrodes 519*a*, 519*b* . . . are arrayed in an alternating manner in an up-down direction. Hereafter, end portions of the inner electrodes 518*a*, 518*b* . . . , and 519*a*, 519*b* . . . on the upstream side in the anticlockwise direction are referred to as upstream ends, and end portions of the inner electrodes 518*a*, 518*b* . . . , and 519*a*, 519*b* . . . on the downstream side in the anticlockwise direction are referred to as downstream ends.

The downstream ends of the inner electrodes 518*a*, 518*b* . . . are bent toward the inside of the region enclosed by the inner electrodes 518*a*, 518*b* . . . The upstream ends of the inner electrodes 519*a*, 519*b* . . . are bent toward the inside of the region enclosed by the inner electrodes 519*a*, 519*b* . . . The downstream end of the inner electrode 518*a* and the upstream end of the inner electrode 519*a* are connected to each other. The downstream end of the inner electrode 518*b* and the upstream end of the inner electrode 519*b* are connected to each other. In addition, the downstream end of the inner electrode 519*a* and the upstream end of the inner electrode 518*a* are connected to each other. Thus, the inner electrodes 518*a*, 519*a*, 518*b* and 519*b* are connected in series with each other. Furthermore, inner electrodes 518*c* and 519*c* and inner electrodes thereafter are connected to each other in a similar manner to the inner electrodes 518*a*, 518*b*, 519*a* and 519*b*. The helical-shaped inductor 511 is formed in this way.

It is difficult to realize a large inductance value in the multilayer inductor 500 disclosed in the above-cited patent document. More specifically, as described above, the downstream ends of the inner electrodes 518*a* and 518*b* are bent toward the inside of the region enclosed by the inner electrodes 518*a* and 518*b*. The upstream ends of the inner electrodes 519*a* and 519*b* are bent toward the inside of the region enclosed by the inner electrodes 519*a* and 519*b*. Therefore, the downstream ends of the inner electrodes 518*a* and 518*b* and the upstream ends of the inner electrodes 519*a* and 519*b* are located inside the region enclosed by the inductor 511 when viewed from above. Consequently, the downstream ends of the inner electrodes 518*a* and 518*b* and the upstream ends of the inner electrodes 519*a* and 519*b* disturb the magnetic flux generated by the inductor 511. Consequently, it is difficult to realize a large inductance value in the multilayer inductor 500.

SUMMARY

Accordingly, an object of the present disclosure is to provide an electronic component that can realize a larger inductance value than was previously possible.

A preferred embodiment of the present disclosure provides an electronic component that includes: a multilayer body having a structure obtained by stacking a plurality of insulator layers including first insulator layers on top of one another in a stacking direction; and an inductor that is provided in the multilayer body. The inductor includes a plurality of first inductor conductor layers, a plurality of second inductor conductor layers and a plurality of connection conductor layers that are superposed with each other when viewed in the stacking direction and thereby form an annular track. The first inductor conductor layers, when viewed in the stacking direction, each include a first superposed portion that is superposed with the second inductor conductor layers, and each include a first non-superposed portion that protrudes from the second inductor conductor layers toward a downstream side when turning in a prescribed direction. The second inductor conductor layers are each provided closer to one side in the stacking direction than a corresponding one of the first inductor conductor layers, and, when viewed in the stacking direction, each include a second superposed portion that is superposed with the first inductor conductor layers and each include a second non-superposed portion that protrudes from the first inductor conductor layers toward an upstream side when turning in the prescribed direction. A plurality of groups are arrayed in the stacking direction, each group consisting of a corresponding one of the first inductor conductor layers, a corresponding one of the second inductor conductor layers, a corresponding one of the connection conductor layers and a corresponding one of the first insulator layers. In each group, the first insulator layer is provided between the first superposed portion of the first inductor conductor layer and the second superposed portion of the second inductor conductor layer included in the same group. In each group, the connection conductor layer is provided at the same position as the first insulator layer in the stacking direction, and electrically connects the first non-superposed portion of the first inductor conductor layer and the second non-superposed portion of the second inductor conductor layer included in the same group to each other. At least part of the second superposed portion of the second inductor conductor layer included in a group located on another side in the stacking direction among two groups that are adjacent to each other in the stacking direction and at least part of the first superposed portion of the first inductor conductor layer included in a group located on the one side in the stacking direction among the two groups that are adjacent to each other in the stacking direction are physically connected to each other or are connected to each other via a conductor.

According to the preferred embodiment of the present disclosure, a larger inductance value than was previously possible can be realized.

Other features, elements, characteristics and advantages of the present disclosure will become more apparent from the following detailed description of preferred embodiments of the present disclosure with reference to the attached drawings.

DETAILED DESCRIPTION

Configuration of Electronic Component

Figure 1:
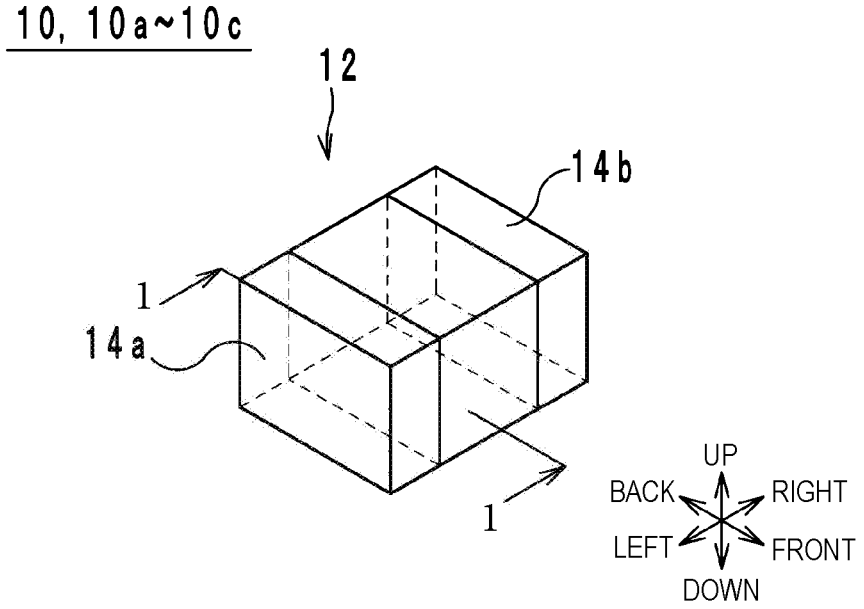
FIG. 1 is an external perspective view of an electronic component.
Figure 2:
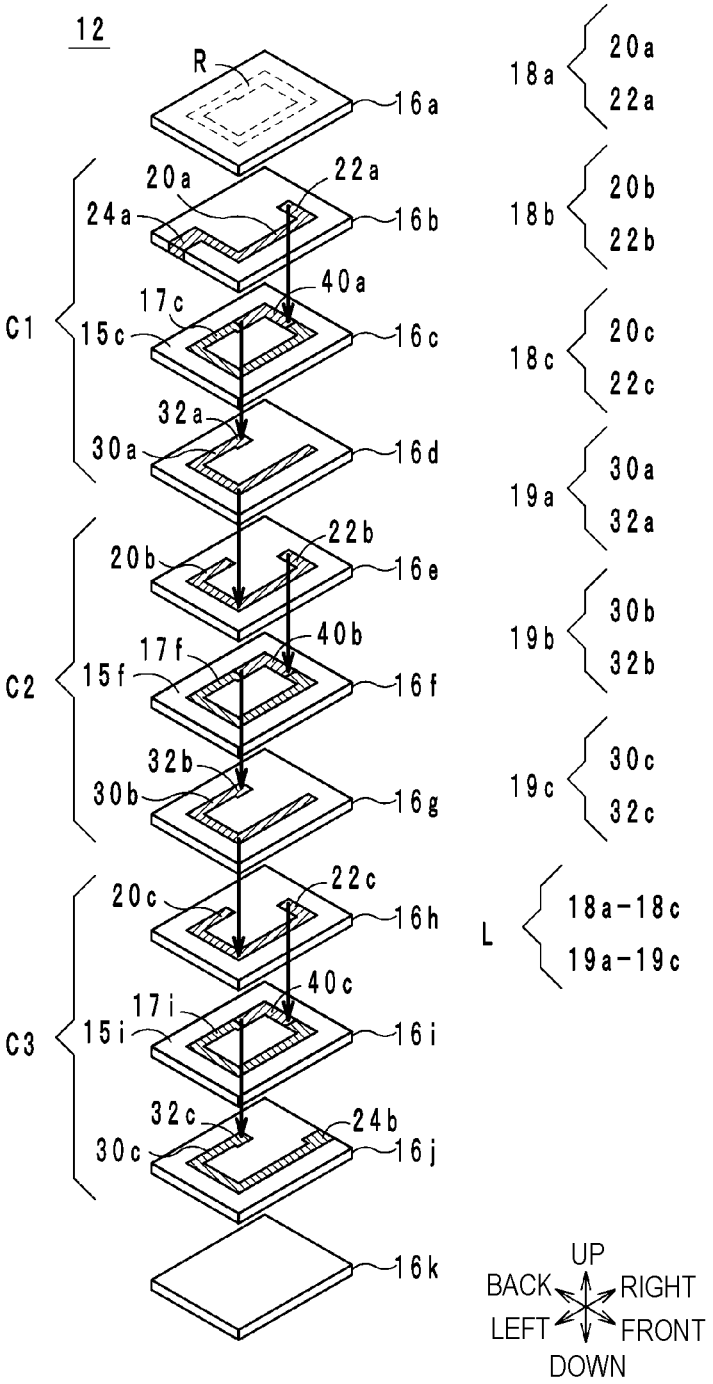
FIG. 2 is an exploded perspective view of a multilayer body of the electronic component.
Figure 3:
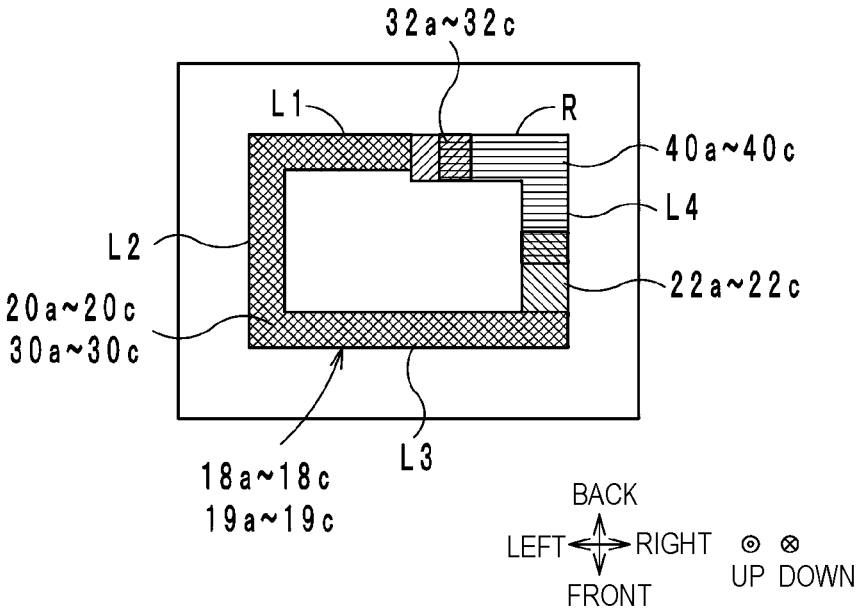
FIG. 3 illustrates inductor conductor layers and connection conductor layers viewed from above.
Figure 4:
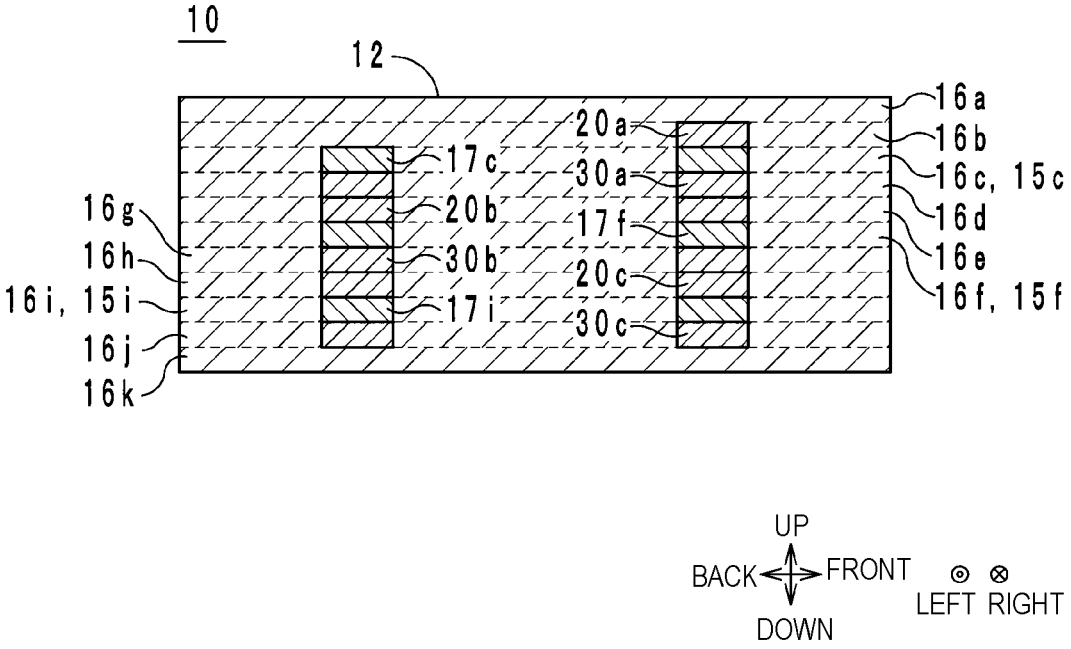
FIG. 4 is a sectional structural view taken along line 1-1 in FIG. 1.

Hereafter, the configuration of an electronic component according to an embodiment of the present disclosure will be described while referring to the drawings. FIG. 1 is an external perspective view of an electronic component 10, 10*a*, 10*b* or 10*c*. FIG. 2 is an exploded perspective view of a multilayer body 12 of the electronic component 10. FIG. 3 illustrates inductor conductor layers 18*a* to 18*c* and 19*a* to 19*c*, and connection conductor layers 40*a* to 40*c* from above. FIG. 4 is a sectional structural view taken along line 1-1 in FIG. 1.

Hereafter, a stacking direction of the electronic component 10 is defined as an up-down direction (a lower side is an example of one side in the stacking direction, and an upper side is an example of the other side in the stacking direction). Furthermore, when the electronic component 10 is viewed from above, a direction in which the long sides of the electronic component 10 extend is defined as a left-right direction, and a direction in which the short sides of the electronic component 10 extend is defined as a front-back direction. The up-down direction, the front-back direction and the left-right direction are perpendicular to one another. The up-down direction, the front-back direction and the left-right direction are merely examples, and do not need to match the up-down direction, the front-back direction and the left-right direction utilized when the electronic component 10 is actually used.

As illustrated in FIGS. 1 and 2, the electronic component 10 includes the multilayer body 12, outer electrodes 14*a* and 14*b*, leading out conductor layers 24*a* and 24*b*, and an inductor L. As illustrated in FIG. 2, the multilayer body 12 has a substantially rectangular parallelepiped shape, and has a structure obtained by stacking insulator layers 16*a* to 16*k* (example of a plurality of insulator layers) such that the insulator layers 16*a* to 16*k* are arrayed in order from the upper side to the lower side. The multilayer body 12 has an upper surface, a lower surface, a right surface, a left surface, a front surface and a back surface. The right surface, the left surface, the front surface and the back surface of the multilayer body 12 are lateral surfaces that are parallel to the up-down direction.

The insulator layers 16*a*, 16*b*, 16*d*, 16*e*, 16*g*, 16*h*, 16*j* and 16*k* are manufactured using a magnetic ferrite (for example, a Ni—Zn—Cu ferrite or a Ni—Zn ferrite), and have a substantially rectangular shape when viewed from above. The insulator layers 16*c*, 16*f* and 16*i* respectively include magnetic portions 15*c*, 15*f* and 15*i* and non-magnetic portions 17*c*, 17*f* and 17*i* (example of first insulator layers), and have a substantially rectangular shape when viewed from above. The magnetic portions 15*c*, 15*f* and 15*i* are manufactured using a magnetic ferrite (for example, a Ni—Zn—Cu ferrite or a Ni—Zn ferrite). The non-magnetic portions 17*c*, 17*f* and 17*i* are manufactured using a non-magnetic (i.e., having a magnetic permeability of 1) ferrite (for example, a Zn—Cu ferrite). However, low-magnetism portions having a lower magnetic permeability than the magnetic portions 15*c*, 15*f* and 15*i* or magnetic portions having substantially the same magnetic permeability as the magnetic portions 15*c*, 15*f* and 15*i* may be provided instead of the non-magnetic portions 17*c*, 17*f* and 17*i*. Before describing the shapes of the magnetic portions 15*c*, 15*f* and 15*i* and the non-magnetic portions 17*c*, 17*f* and 17*i*, a track R will be described while referring to FIG. 3.

As illustrated in FIG. 3, an annular track R is defined in the electronic component 10. The track R has a substantially quadrangular (rectangular in this embodiment) frame-like shape when viewed from above, and has sides L1, L2, L3 and L4. The sides L1 to L4 are connected in order in the anticlockwise direction. The side L1 is a back long side that extends in the left-right direction. The side L1 is parallel to the back surface (example of outer edge) of the multilayer body 12 when viewed from above. The side L3 is a front long side that extends in the left-right direction. The side L3 is parallel to the front surface (example of outer edge) of the multilayer body 12 when viewed from above. The side L2 is a left short side that extends in the front-back direction. The side L2 is parallel to the left surface (example of outer edge) of the multilayer body 12 when viewed from above. The side L4 is a right short side that extends in the front-back direction. Therefore, the side L4 is parallel to the right surface (example of outer edge) of the multilayer body 12 when viewed from above.

The description will now return to the shapes of the magnetic portions 15*c*, 15*f* and 15*i* and the non-magnetic portions 17*c*, 17*f* and 17*i*. As illustrated in FIG. 2, the non-magnetic portions 17*c*, 17*f* and 17*i* are each superposed with the left half of the side L1, the entire side L2, the entire side L3, and the front half of the side L4 of the track R when viewed from above. In other words, the non-magnetic portions 17*c*, 17*f* and 17*i* each have a shape obtained by cutting out a portion close to the back right corner of the rectangular track R. The magnetic portions 15*c*, 15*f* and 15*i* are respectively constituted by parts of the insulator layers 16*c*, 16*f* and 16*i* other than the non-magnetic portions 17*c*, 17*f* and 17*i*. Furthermore, as illustrated in FIG. 4, the non-magnetic portions 17*c*, 17*f* and 17*i* respectively penetrate through the magnetic portions 15*c*, 15*f* and 15*i* in the up-down direction. Thus, the non-magnetic portions 17*c*, 17*f* and 17*i* are respectively exposed from the upper surfaces and the lower surfaces of the insulator layers 16*c*, 16*f* and 16*i*.

As illustrated in FIG. 2, the inductor L is provided inside the multilayer body 12, and has a helical shape that advances from the upper side toward the lower side while turning in the anticlockwise direction (example of turning in prescribed direction). The inductor L includes the inductor conductor layers 18*a* to 18*c* and 19*a* to 19*c*, and the connection conductor layers 40*a* to 40*c*.

The inductor conductor layers 18*a* to 18*c* and 19*a* to 19*c*, and the connection conductor layers 40*a* to 40*c* are each provided along part of the track R when viewed from above. More precisely, as illustrated in FIG. 3, the inductor conductor layers 18*a* to 18*c* and 19*a* to 19*c*, and the connection conductor layers 40*a* to 40*c* are superposed with each other when viewed from above, and thereby form the annular track R.

The inductor conductor layers 18*a* to 18*c* (example of plurality of first inductor conductor layers) are respectively provided at the same positions as the insulator layers 16*b*, 16*e* and 16*h* in the up-down direction. More specifically, the inductor conductor layer 18*a* has a shape that is superposed with the entire side L2, the entire side L3 and the front half of the side L4 when viewed from above, and penetrates through the insulator layer 16*b* in the up-down direction. Therefore, the inductor conductor layer 18*a* is exposed from the upper surface and the lower surface of the insulator layer 16*b*. The inductor conductor layers 18*b* and 18*c* each have a shape that is superposed with the left half of the side L1, the entire side L2, the entire side L3 and the front half of the side L4, and respectively penetrate through the insulator layers 16*e* and 16*h* in the up-down direction. Therefore, the inductor conductor layers 18*b* and 18*c* are respectively exposed from the upper surfaces and the lower surfaces of the insulator layers 16*e* and 16*h*. Thus, the inductor conductor layers 18*a* to 18*c* form a shape that winds in the anticlockwise direction when viewed from above.

The inductor conductor layers 19*a* to 19*c* (example of plurality of second inductor conductor layers) are respectively provided at the same positions as the insulator layers 16*d*, 16*g* and 16*j* in the up-down direction. Therefore, the inductor conductor layers 19*a* to 19*c* are respectively provided below the inductor conductor layers 18*a* to 18*c*. More specifically, the inductor conductor layers 19*a* to 19*c* each have a shape that is superposed with the left half of the side L1, the entire side L2 and the entire side L3 when viewed from above, and respectively penetrate through the insulator layers 16*d*, 16*g* and 16*j* in the up-down direction. Therefore, the inductor conductor layers 19*a* to 19*c* are respectively exposed at the upper surfaces and the lower surfaces of the insulator layers 16*d*, 16*g* and 16*j*. Thus, the inductor conductor layers 19*a* to 19*c* form a shape that winds in the anticlockwise direction when viewed from above. Hereafter, in each conductor layer, an end portion on the upstream side in the anticlockwise direction is simply referred to as an upstream end, and an end portion on the downstream side in the anticlockwise direction is simply referred to as a downstream end.

Here, as illustrated in FIG. 3, the inductor conductor layers 18*a* to 18*c* and the inductor conductor layers 19*a* to 19*c* are partially superposed with each other when viewed from above. In more detail, the inductor conductor layers 18*a* to 18*c* respectively include superposed portions 20*a* to 20*c* (example of first superposed portions) and non-superposed portions 22*a* to 22*c* (example of first non-superposed portions). The superposed portions 20*a* to 20*c* are respectively parts of the inductor conductor layers 18*a* to 18*c* that are superposed with the inductor conductor layers 19*a* to 19*c* when viewed from above. The superposed portion 20*a* has a shape that is superposed with the entire side L2 and the side L3 when viewed from above. The superposed portions 20*b* and 20*c* each have a shape that is superposed with the left half of the side L1, the entire side L2 and the entire side L3 when viewed from above. The non-superposed portions 22*a* to 22*c* are respectively portions of the inductor conductor layers 18*a* to 18*c* that protrude toward the downstream side in the anticlockwise direction from the inductor conductor layers 19*a* to 19*c*. The non-superposed portions 22*a* to 22*c* each have a shape that is superposed with the front half of the side L4 when viewed from above. Therefore, the non-superposed portions 22*a* to 22*c* are respectively connected to the downstream ends of the superposed portions 20*a* to 20*c*. In addition, the non-superposed portions 22*a* to 22*c* have a larger line width than the superposed portions 20*a* to 20*c*. "Line width" refers to the size of an inductor conductor in a direction orthogonal to the direction in which the inductor conductor extends when viewed from above.

The inductor conductor layers 19*a* to 19*c* respectively include superposed portions 30*a* to 30*c* (example of second superposed portions) and non-superposed portions 32*a* to 32*c* (example of second non-superposed portions). The superposed portions 30*a* to 30*c* are respectively parts of the inductor conductor layers 19*a* to 19*c* that are superposed with the inductor conductor layers 18*a* to 18*c* when viewed from above. The superposed portions 30*a* to 30*c* each have a shape that is superposed with the left half of the side L1, the entire side L2 and the entire side L3 when viewed from above. The non-superposed portions 32*a* to 32*c* are respectively portions of the inductor conductor layers 19*a* to 19*c* that protrude toward the upstream side in the anticlockwise direction from the inductor conductor layers 18*a* to 18*c*. The non-superposed portions 32*a* to 32*c* each have a shape that is superposed with the right half of the side L1 when viewed from above. Therefore, the non-superposed portions 32*a* to 32*c* are respectively connected to the upstream ends of the superposed portions 30*a* to 30*c*. In addition, the non-superposed portions 32*a* to 32*c* have a larger line width than the superposed portions 30*a* to 30*c*.

The inductor conductor layers 18*a* and 19*a*, the connection conductor layer 40*a* and the non-magnetic portion 17*c* (example of first insulator layer) form a group C1. The inductor conductor layers 18*b* and 19*b*, the connection conductor layer 40*b* and the non-magnetic portion 17*f* (example of first insulator layer) form a group C2. The inductor conductor layers 18*c* and 19*c*, the connection conductor layer 40*c* and the non-magnetic portion 17*i* (example of first insulator layer) form a group C3. The groups C1 to C3 (example of plurality of groups) are arrayed in order from the upper side to the lower side.

As illustrated in FIGS. 2 and 4, there is no insulator layer between the superposed portion 30*a* of the inductor conductor layer 19*a* and the superposed portion 20*b* of the inductor conductor layer 18*b*. Thus, the entirety of the superposed portion 30*a* of the inductor conductor layer 19*a* (example of second inductor conductor layer included in group positioned on other side in stacking direction among two groups adjacent to each other in stacking direction) and part of the superposed portion 20*b* of the inductor conductor layer 18*b* (example of first inductor conductor layer included in group positioned on one side in stacking direction among two groups adjacent to each other in stacking direction) contact each other, and are thereby physically connected to each other. Therefore, the inductor conductor layer 19*a* and the inductor conductor layer 18*b* are connected in series with each other. As illustrated in FIGS. 2 and 4, there is no insulator layer between the superposed portion 30*b* of the inductor conductor layer 19*b* and the superposed portion 20*c* of the inductor conductor layer 18*c*. Thus, the entirety of the superposed portion 30*b* of the inductor conductor layer 19*b* (example of second inductor conductor layer included in group positioned on other side in stacking direction among two groups adjacent to each other in stacking direction) and the entirety of the superposed portion 20*c* of the inductor conductor layer 18*c* (example of first inductor conductor layer included in group positioned on one side in stacking direction among two groups adjacent to each other in stacking direction) contact each other, and are thereby physically connected to each other. Therefore, the inductor conductor layer 19*b* and the inductor conductor layer 18*c* are connected in series with each other.

Furthermore, as illustrated in FIGS. 2 and 4, the non-magnetic portion 17*c* is provided between the superposed portion 20*a* of the inductor conductor layer 18*a* and the superposed portion 30*a* of the inductor conductor layer 19*a* included in the same group C1. Thus, the superposed portion 20*a* and the superposed portion 30*a* are insulated from each other. The non-magnetic portion 17*f* is provided between the superposed portion 20*b* of the inductor conductor layer 18*b* and the superposed portion 30*b* of the inductor conductor layer 19*b* included in the same group C2. Thus, the superposed portion 20*b* and the superposed portion 30*b* are insulated from each other. The non-magnetic portion 17*i* is provided between the superposed portion 20*c* of the inductor conductor layer 18*c* and the superposed portion 30*c* of the inductor conductor layer 19*c* included in the same group C3. Thus, the superposed portion 20*c* and the superposed portion 30*c* are insulated from each other.

The connection conductor layers 40*a* to 40*c* (example of plurality of connection conductor layers) are respectively provided at the same positions as the insulator layers 16*c*, 16*f* and 16*i* in the up-down direction. In more detail, the connection conductor layers 40*a* to 40*c* respectively penetrate through the insulator layers 16*c*, 16*f* and 16*i* in the up-down direction. Therefore, the connection conductor layers 40*a* to 40*c* are respectively exposed from the upper surfaces and the lower surfaces of the insulator layers 16*c*, 16*f* and 16*i*.

The connection conductor layers 40*a* to 40*c* have the same shape as each other, and therefore their shape will be collectively described. The connection conductor layers 40*a* to 40*c* each have a shape when viewed from above such that the connection conductor layer is provided close to the back right corner of the track R, is superposed with and extends between a region close to the right end of the side L1 (example of first long side) and a region close to the back end of the side L4 (example of first short side), and is not superposed with the sides L2 and L3 (side L2 is example of second short side, and side L3 is example of second long side). Thus, when viewed from above, the connection conductor layers 40*a* to 40*c* have a shape that winds in the anticlockwise direction, and are substantially L-shaped.

When viewed from above, the upstream ends of the connection conductor layers 40*a* to 40*c* are respectively superposed with the non-superposed portions 22*a* to 22*c* of the inductor conductor layers 18*a* to 18*c*. Since there are no insulator layers between the connection conductor layers 40*a* to 40*c* and the non-superposed portions 22*a* to 22*c*, the connection conductor layers 40*a* to 40*c* and the non-superposed portions 22*a* to 22*c* respectively contact each other, and are thereby physically connected to each other. Thus, the inductor conductor layers 18*a* to 18*c* and the connection conductor layers 40*a* to 40*c* are respectively connected in series with each other. However, as illustrated in FIG. 3, there are gaps between the upstream ends of the connection conductor layers 40*a* to 40*c* and the downstream ends of the superposed portions 30*a* to 30*c* when viewed from above. Thus, the upstream ends of the connection conductor layers 40*a* to 40*c* and the superposed portions 30*a* to 30*c* are respectively insulated from each other.

When viewed from above, the downstream ends of the connection conductor layers 40*a* to 40*c* are respectively superposed with the non-superposed portions 32*a* to 32*c* of the inductor conductor layers 19*a* to 19*c*. Since there are no insulator layers between the connection conductor layers 40*a* to 40*c* and the non-superposed portions 32*a* to 32*c*, the connection conductor layers 40*a* to 40*c* and the non-superposed portions 32*a* to 32*c* respectively contact each other, and are thereby physically connected to each other. Thus, the inductor conductor layers 19*a* to 19*c* and the connection conductor layers 40*a* to 40*c* are respectively connected in series with each other. However, as illustrated in FIG. 3, there are gaps between the downstream ends of the connection conductor layers 40*b* and 40*c* and the upstream ends of the superposed portions 20*b* and 20*c* when viewed from above. Thus, the upstream ends of the connection conductor layers 40*b* and 40*c* and the superposed portions 20*b* and 20*c* are respectively insulated from each other.

As described above, the connection conductor layer 40*a* electrically connects the non-superposed portion 22*a* of the inductor conductor layer 18*a* and the non-superposed portion 32*a* of the inductor conductor layer 19*a,* which are included in the same group C1, to each other. The connection conductor layer 40*b* electrically connects the non-superposed portion 22*b* of the inductor conductor layer 18*b* and the non-superposed portion 32*b* of the inductor conductor layer 19*b,* which are included in the same group C2, to each other. The connection conductor layer 40*c* electrically connects the non-superposed portion 22*c* of the inductor conductor layer 18*c* and the non-superposed portion 32*c* of the inductor conductor layer 19*c,* which are included in the same group C3, to each other.

The line width of the connection conductor layers 40*a* to 40*c* and the line width of the non-superposed portions 22*a* to 22*c* and 32*a* to 32*c* are larger than the line width of the superposed portions 20*a* to 20*c* and 30*a* to 30*c*. Thus, the line width of the part of the track R that is superposed with the connection conductor layers 40*a* to 40*c* and the non-superposed portions 22*a* to 22*c* and 32*a* to 32*c* (that is, in a region close to the back right corner) is larger than the line width of the remaining part of the track R.

The leading out conductor layer 24*a* is provided at the same position as the insulator layer 16*b* in the up-down direction. In more detail, when viewed from above, the leading out conductor layer 24*a* is connected to the upstream end of the inductor conductor layer 18*a* and is led out to the left short side of the insulator layer 16*b*. In addition, the leading out conductor layer 24*a* penetrates through the insulator layer 16*b* in the up-down direction. Therefore, the leading out conductor layer 24*a* is exposed from the upper surface and the lower surface of the insulator layer 16*b*.

The leading out conductor layer 24*b* is provided at the same position as the insulator layer 16*j* in the up-down direction. In more detail, when viewed from above, the leading out conductor layer 24*b* is connected to the downstream end of the inductor conductor layer 19*c* and is led out to the right short side of the insulator layer 16*j*. In addition, the leading out conductor layer 24*b* penetrates through the insulator layer 16*j* in the up-down direction. Therefore, the leading out conductor layer 24*b* is exposed from the upper surface and the lower surface of the insulator layer 16*j*.

The thus-configured inductor conductor layers 18*a* to 18*c* and 19*a* to 19*c,* the leading out conductor layers 24*a* and 24*b,* and the connection conductor layers 40*a* to 40*c* are manufactured using a conductor having Ag, Cu or the like as a main component, for example.

As illustrated in FIG. 1, the outer electrode 14*a* covers the entire left surface of the multilayer body 12 and is bent around onto the upper surface, the lower surface, the front surface and the back surface of the multilayer body 12. Thus, the outer electrode 14*a* is connected to the leading out conductor layer 24*a* and is electrically connected to the inductor L.

As illustrated in FIG. 1, the outer electrode 14*b* covers the entire right surface of the multilayer body 12 and is bent around onto the upper surface, the lower surface, the front surface and the back surface of the multilayer body 12. Thus, the outer electrode 14*b* is connected to the leading out conductor layer 24*b* and is electrically connected to the inductor L. In addition, the connection conductor layers 40*a* to 40*c* are superposed with the side L4 when viewed from above. When viewed from above, the side L4 is the side that is closest to the right surface (example of first lateral surface) among the sides L1 to L4 of the track R, and is parallel to the right surface. Thus, the connection conductor layers 40*a* to 40*c* are close to the outer electrode 14*b*. The outer electrodes 14*a* and 14*b* are formed by applying Ni plating and Sn plating to a base electrode formed of a material having Ag or the like as a main component, for example.

Method of Manufacturing Electronic Component

Hereafter, a method of manufacturing the electronic component 10 will be described while referring to FIGS. 5A to 5J and 6A to 6H. FIGS. 5A to 5J are step sectional views taken during manufacture of the electronic component 10 along line 1-1 in FIG. 1. FIGS. 6A to 6H are plan views illustrating the state during the manufacture of the electronic component 10 from above. In FIGS. 5A to 5J and 6A to 6H, the situation during the manufacture of one electronic component 10 is illustrated, but in the actual manufacturing process, a mother multilayer body would be manufactured, and then the mother multilayer body would be cut into a plurality of multilayer bodies 12.

A first ceramic slurry that will serve as the raw material of the insulator layers 16*a,* 16*b,* 16*d,* 16*e,* 16*g,* 16*h,* 16*j* and 16*k* and the magnetic portions 15*c,* 15*f* and 15*i* is manufactured. Ferric oxide ($Fe_2O_3$) is weighed in a ratio of 48.0 mol %, zinc oxide (ZnO) is weighed in a ratio of 20.0 mol %, nickel oxide (NiO) is weighed in a ratio of 23.0 mol % and copper oxide (CuO) is weighed in a ratio of 9.0 mol %, these materials are placed in a ball mill as raw materials, and subjected to wet mixing. After being dried, the resulting mixture is pulverized and the resulting powder is calcined at 750° C. for one hour. The obtained calcined powder is subjected to wet pulverization in a ball mill, is dried and is then cracked, and as a result, a ferrite ceramic powder is obtained.

A binder (vinyl acetate, a water-soluble acrylic or the like), a plasticizer, a wetting material, and a dispersing agent are added to the ferrite ceramic powder, and mixing is performed in a ball mill, and after that degassing is performed by reducing the pressure. Thus, the first ceramic slurry, which will serve as the raw material of the insulator layers 16*a* and 16*h* and the magnetic portions 15*c,* 15*f* and 15*i,* is obtained.

Next, a second ceramic slurry, which will serve as the raw material of the non-magnetic portions 17*c,* 17*f* and 17*i,* is manufactured. Ferric oxide ($Fe_2O_3$) is weighed in a ratio of 48.0 mol %, zinc oxide (ZnO) is weighed in a ratio of 43.0 mol %, and copper oxide (CuO) is weighed in a ratio of 9.0 mol %, these materials are placed in a ball mill as raw materials, and subjected to wet mixing. After being dried, the resulting mixture is pulverized and the resulting powder is calcined at 750° C. for one hour. The obtained calcined powder is subjected to wet pulverization in a ball mill, is dried and is then cracked, and as a result, a ferrite ceramic powder is obtained.

A binder (vinyl acetate, a water-soluble acrylic or the like), a plasticizer, a wetting material, and a dispersing agent are added to the ferrite ceramic powder, and mixing is performed in a ball mill, and after that degassing is performed by reducing the pressure. Thus, the second ceramic slurry, which will serve as the raw material of the non-magnetic portions 17*c,* 17*f* and 17*i,* is obtained.

Figure 5A:
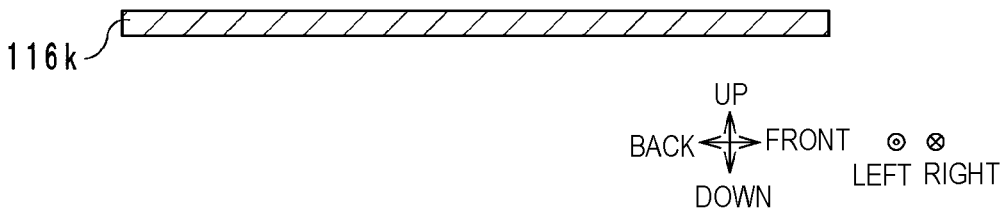
FIG. 5A is a step sectional view at a time during manufacture of the electronic component taken along line 1-1 in FIG. 1.
Figure 6A:
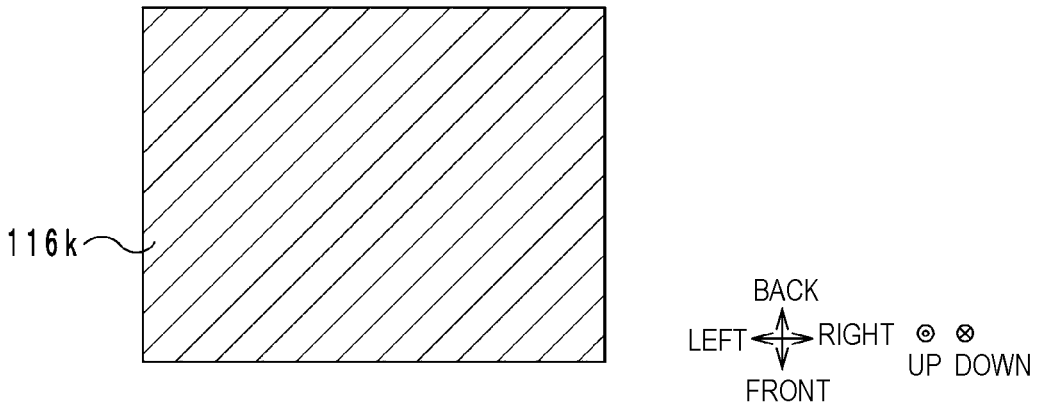
FIG. 6A is a plan view illustrating the state during the manufacture of the electronic component from above.

Next, as illustrated in FIGS. 5A and 6A, a ceramic green layer 116*k,* which will become the insulator layer 16*k,* is formed by applying the first ceramic slurry by performing printing.

Figure 5B:
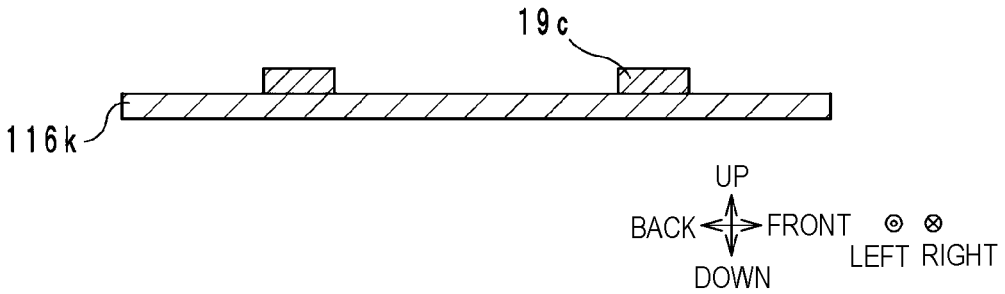
FIG. 5B is a step sectional view at a time during manufacture of the electronic component taken along line 1-1 in FIG. 1.
Figure 6B:
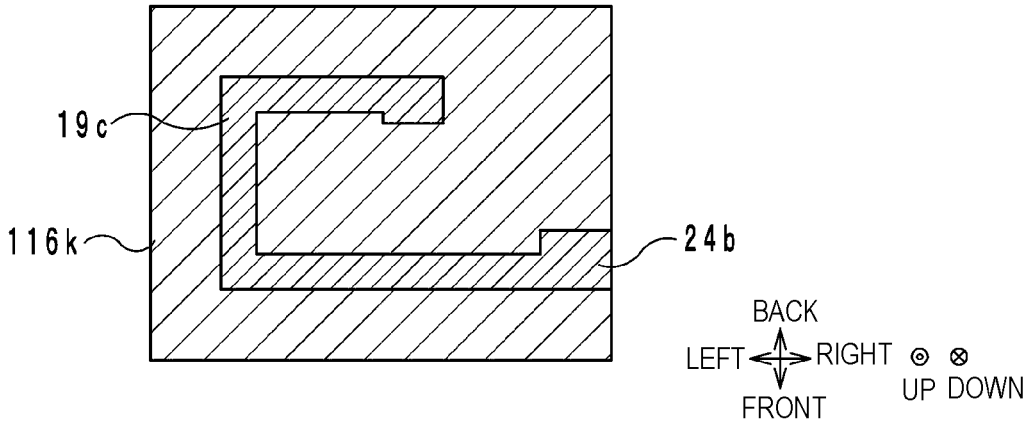
FIG. 6B is a plan view illustrating the state during the manufacture of the electronic component from above.

Next, as illustrated in FIGS. 5B and 6B, the inductor conductor layer 19*c* and the leading out conductor layer 24*b* are formed on the ceramic green layer 116*k* by applying a conductive paste having a main component of Ag, Pd, Cu, Au or an alloy of any of these metals by using a method such as a screen printing method or a photolithography method.

Figure 5C:
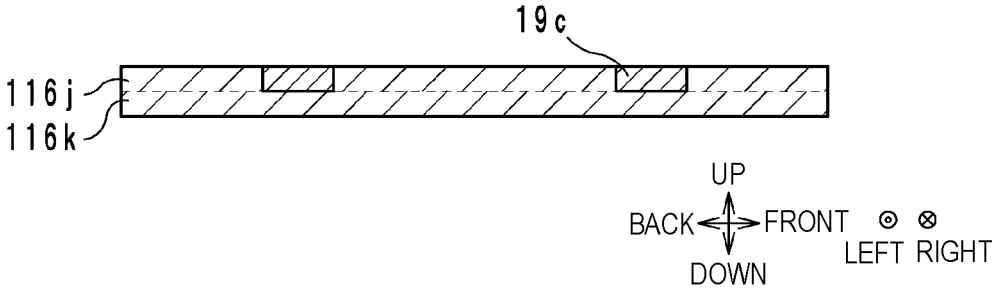
FIG. 5C is a step sectional view at a time during manufacture of the electronic component taken along line 1-1 in FIG. 1.
Figure 6C:
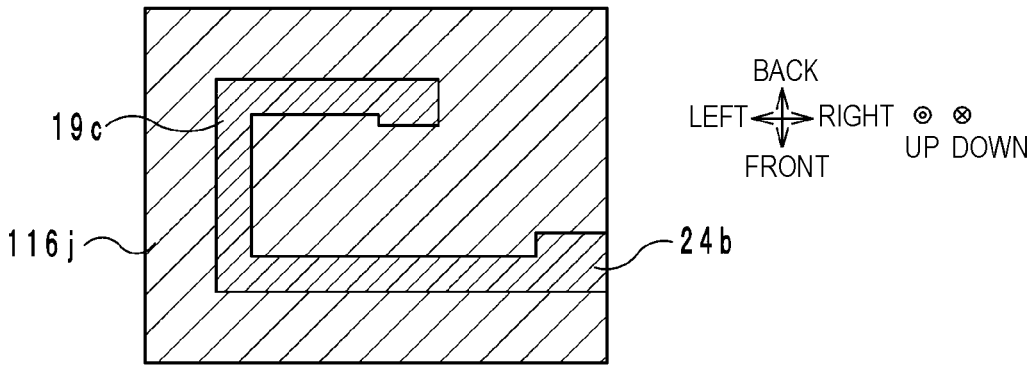
FIG. 6C is a plan view illustrating the state during the manufacture of the electronic component from above.

Next, as illustrated in FIGS. 5C and 6C, a ceramic green layer 116*j*, which will become the insulator layer 16*j*, is formed on the ceramic green layer 116*k* by applying the first ceramic slurry using a screen printing method.

Figure 5D:
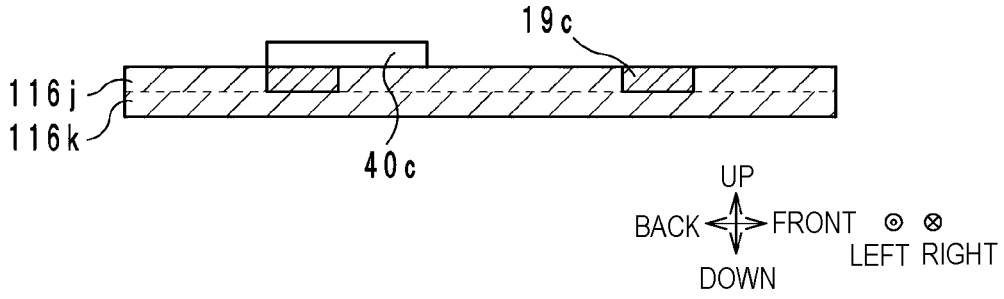
FIG. 5D is a step sectional view at a time during manufacture of the electronic component taken along line 1-1 in FIG. 1.
Figure 6D:
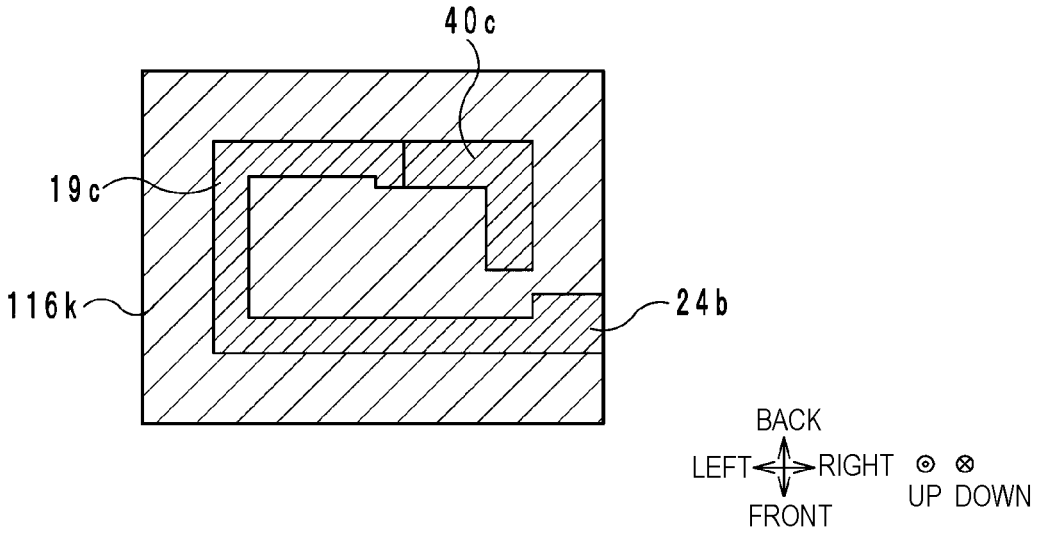
FIG. 6D is a plan view illustrating the state during the manufacture of the electronic component from above.

Next, as illustrated in FIGS. 5D and 6D, the connection conductor layer 40*c* is formed on the ceramic green layer 116*j* and the non-superposed portion 32*c* by applying a conductive paste having a main component of Ag, Pd, Cu, Au or an alloy of any of these metals by using a method such a screen printing method or a photolithography method.

Figure 5E:
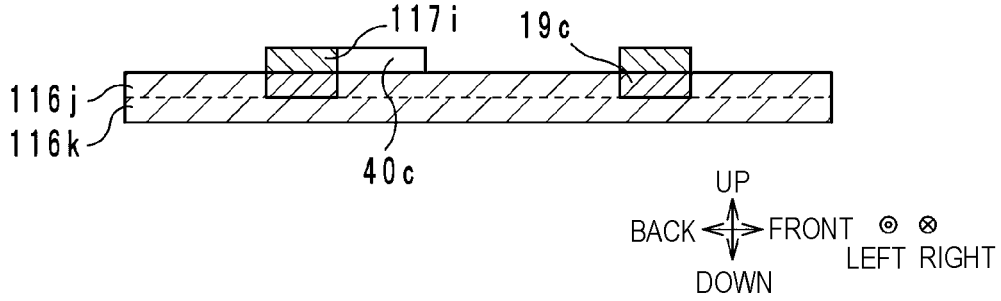
FIG. 5E is a step sectional view at a time during manufacture of the electronic component taken along line 1-1 in FIG. 1.
Figure 6E:
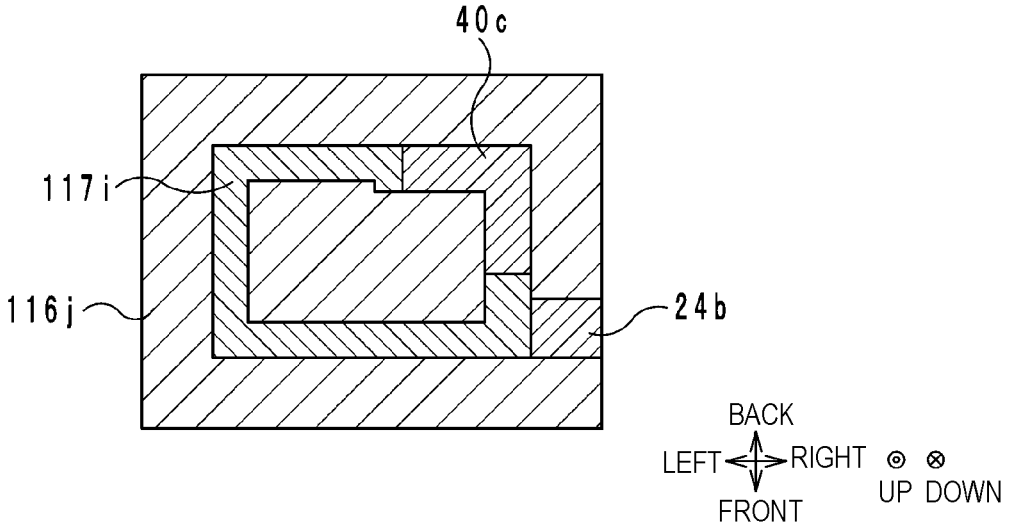
FIG. 6E is a plan view illustrating the state during the manufacture of the electronic component from above.

Next, as illustrated in FIGS. 5E and 6E, a ceramic green portion 117*i*, which will become the non-magnetic portion 17*i*, is formed on the inductor conductor layer 19*c* and the ceramic green layer 116*j* by applying the second ceramic slurry using a screen printing method.

Figure 5F:
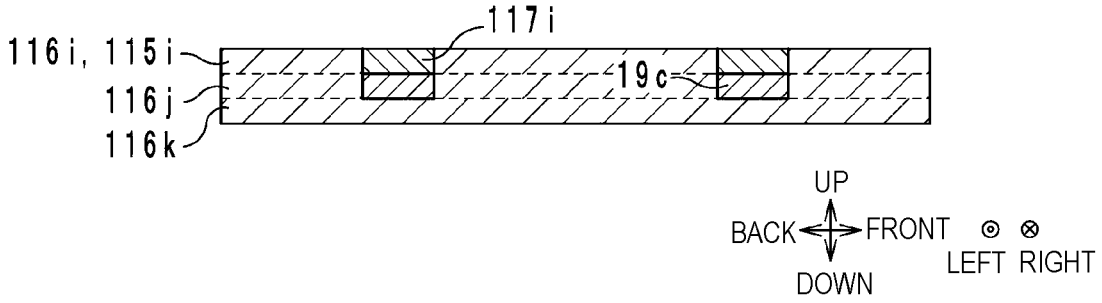
FIG. 5F is a step sectional view at a time during manufacture of the electronic component taken along line 1-1 in FIG. 1.
Figure 6F:
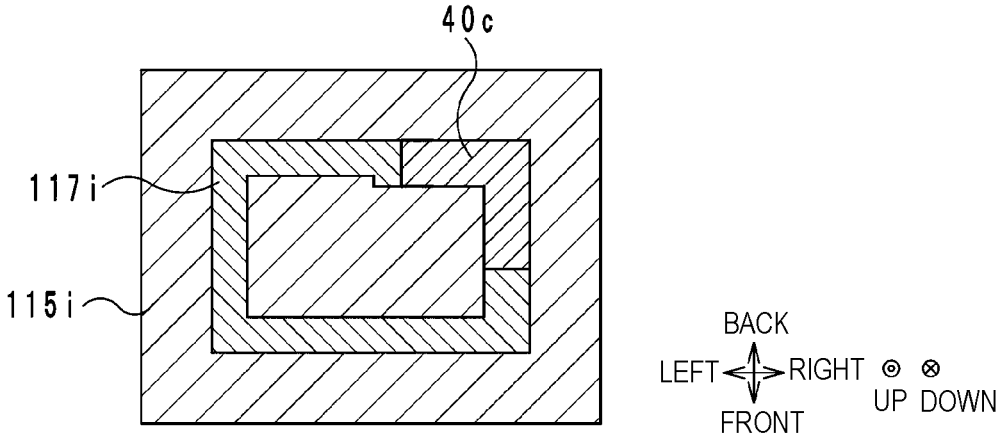
FIG. 6F is a plan view illustrating the state during the manufacture of the electronic component from above.

Next, as illustrated in FIGS. 5F and 6F, a ceramic green portion 115*i*, which will become the magnetic portion 15*i*, is formed on the ceramic green layer 116*j* and the leading out conductor layer 24*b* by applying the first ceramic slurry using a screen printing method.

Figure 5G:
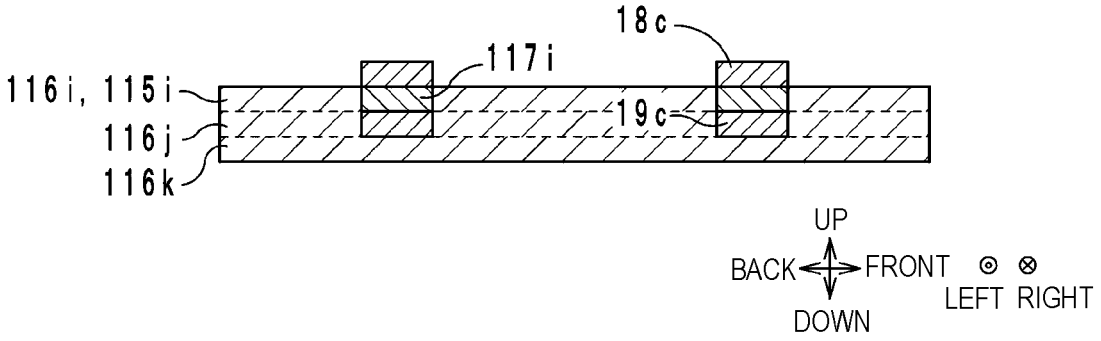
FIG. 5G is a step sectional view at a time during manufacture of the electronic component taken along line 1-1 in FIG. 1.
Figure 6G:
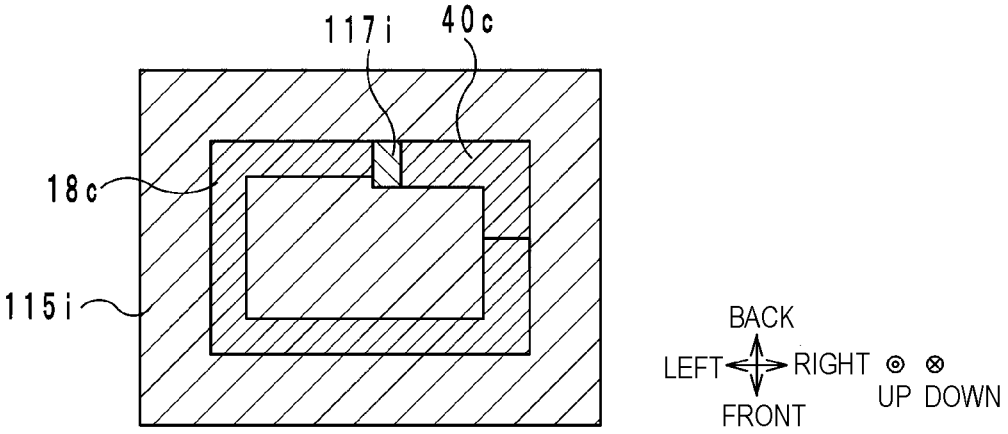
FIG. 6G is a plan view illustrating the state during the manufacture of the electronic component from above.

Next, as illustrated in FIGS. 5G and 6G, the inductor conductor layer 18*c* is formed on the connection conductor layer 40*c* and a ceramic green layer 116*i* by applying a conductive paste having a main component of Ag, Pd, Cu, Au or an alloy of any of these metals by using a method such a screen printing method or a photolithography method.

Figure 5H:
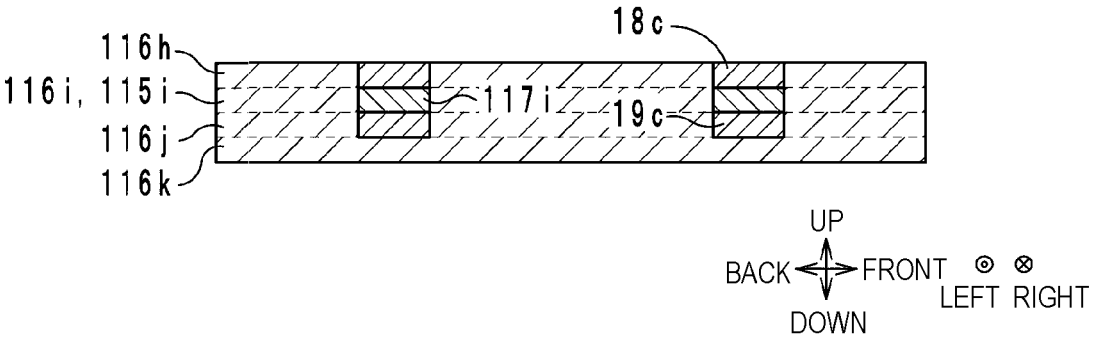
FIG. 5H is a step sectional view at a time during manufacture of the electronic component taken along line 1-1 in FIG. 1.
Figure 6H:
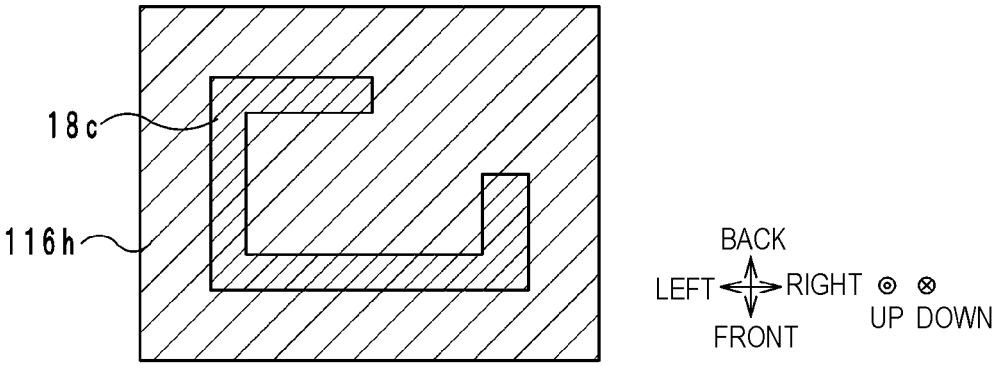
FIG. 6H is a plan view illustrating the state during the manufacture of the electronic component from above.

Next, as illustrated in FIGS. 5H and 6H, a ceramic green layer 116*h*, which will become the insulator layer 16*h*, is formed on the ceramic green layer 116*i* and the connection conductor layer 40*c* by applying the first ceramic slurry using a screen printing method.

Figure 5I:
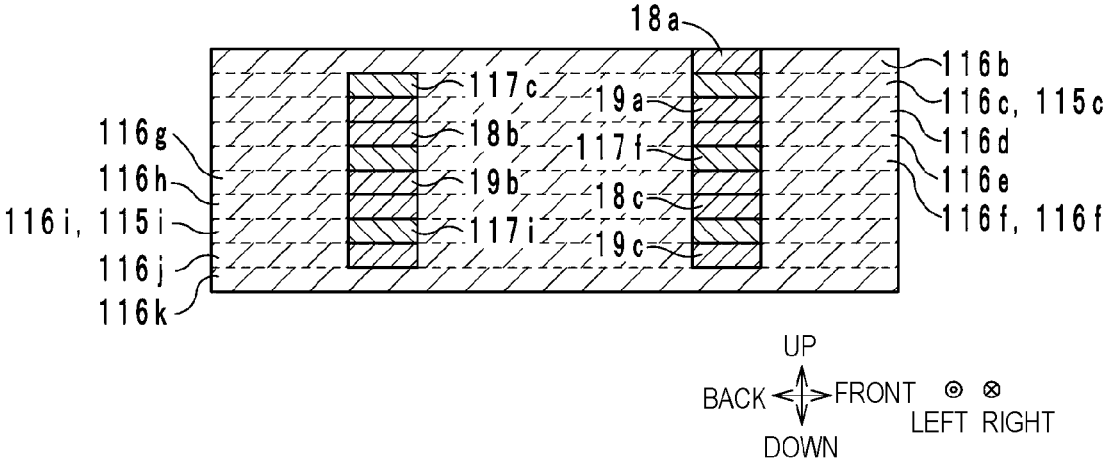
FIG. 5I is a step sectional view at a time during manufacture of the electronic component taken along line 1-1 in FIG. 1.

The inductor conductor layers 18*c* and 19*c*, the leading out conductor layer 24*b*, the connection conductor layer 40*c*, the ceramic green layers 116*h* and 116*j* and the ceramic green portions 115*i* and 117*i* included in the group C3 are formed through the steps illustrated in FIGS. 5B to 5H and 6B to 6H described above. Furthermore, as illustrated in FIG. 5I, the inductor conductor layers 18*a* and 19*a*, the leading out conductor layer 24*a*, the connection conductor layer 40*a*, the ceramic green layers 116*b* and 116*d* and the ceramic green portions 115*c* and 117*c* included in the group C1, and the inductor conductor layers 18*b* and 19*b*, the connection conductor layer 40*b*, the ceramic green layers 116*e* and 116*g* and the ceramic green portions 115*f* and 117*f* included in the group C2 are formed by repeating the steps illustrated in FIGS. 5B to 5H and 6B to 6H two times.

Figure 5J:
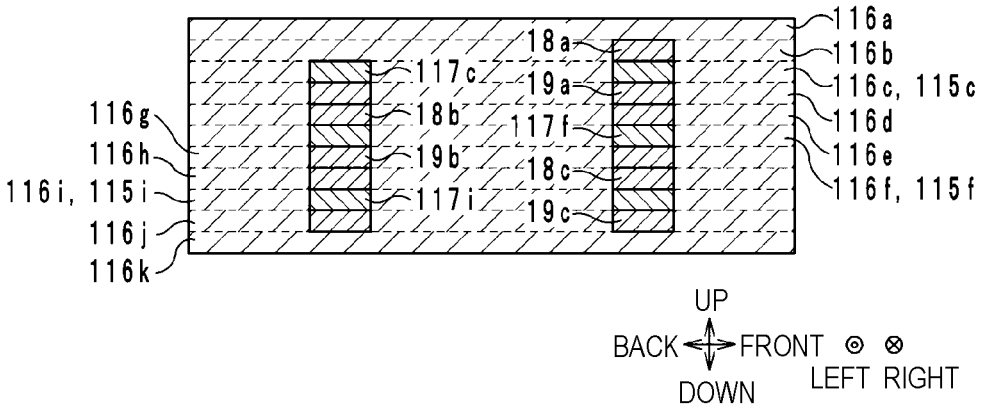
FIG. 5J is a step sectional view at a time during manufacture of the electronic component taken along line 1-1 in FIG. 1.

Next, as illustrated in FIG. 5J, the ceramic green layer 116*a*, which will become the insulator layer 16*a*, is formed on the ceramic green layer 116*b*, the inductor conductor layer 18*a* and the leading out conductor layer 24*a* by applying the first ceramic slurry using a screen printing method. A mother multilayer body is formed through the above-described steps. The mother multilayer body is subjected to permanent pressure bonding using an isostatic press, for example. The permanent pressure bonding is performed under conditions of 45° C. and 1.0 t/cm$^2$, for example.

Next, the mother multilayer body is cut into multilayer bodies 12 of a prescribed size (for example, 3.2 mm×2.5 mm×0.8 mm). Thus, unfired multilayer bodies 12 are obtained. Next, each unfired multilayer body 12 is subjected to a de-binder treatment and firing. The de-binder treatment is performed under conditions of 500° C. for 2 hours in a low oxygen atmosphere, for example. The firing is performed under conditions of 890° C. for 2.5 hours in the atmosphere, for example.

A fired multilayer body 12 is obtained through the above-described steps. The multilayer body 12 is chamfered by being subjected to barrel finishing. After that, base electrodes, which will form part of the outer electrodes 14*a* and 14*b*, are formed by applying a conductive paste having Ag as a main component using a dipping method for example and then performing baking. The base electrodes are dried at 100° C. for 10 minutes, and then the base electrodes are baked under conditions of 780° C. for 2.5 hours.

Finally, formation of the outer electrodes 14*a* and 14*b* is completed by applying Ni plating and Sn plating to the surfaces of the base electrodes. Through the above steps, the electronic component 10 illustrated in FIG. 1 is completed.

Effects

According to the electronic component 10, a larger inductance value than was previously possible can be realized. Hereafter, this effect will be described while taking the group C2 as an example. The inductor conductor layer 18*b* includes the superposed portion 20*b* and the non-superposed portion 22*b*. The inductor conductor layer 19*b* includes the superposed portion 30*b* and the non-superposed portion 32*b*. The superposed portion 20*b* and the superposed portion 30*b* are superposed with each other when viewed from above. However, since the non-magnetic portion 17*f* is provided between the superposed portion 20*b* and the superposed portion 30*b*, the superposed portion 20*b* and the superposed portion 30*b* are insulated from each other. The non-superposed portion 22*b* protrudes from the inductor conductor layer 19*b* toward the downstream side in the anticlockwise direction when viewed from above. In addition, the non-superposed portion 32*b* protrudes from the inductor conductor layer 18*b* toward the upstream side in the anticlockwise direction when viewed from above. Thus, the connection conductor layer 40*b* connects the non-superposed portion 22*b* and the non-superposed portion 32*b* to each other, and as a result, the inductor conductor layer 18*b* and the inductor conductor layer 19*b* are connected in series with each other. The groups C1 and C3 have a similar configuration to the group C2. In addition, the superposed portion 30*a* and the superposed portion 20*b* are connected to each other. Similarly, the superposed portion 30*b* and the superposed portion 20*c* are connected to each other. With this configuration, the inductor conductor layers 18*a*, 19*a*, 18*b*, 19*b*, 18*c* and 19*c* are connected in series with each other. Furthermore, the connection conductor layers 40*a* to 40*c* are provided close to the back right corner of the track R, and do intrude into the region inside the track R. As a result, conductors for connecting the inductor conductor layers 18*a*, 19*a*, 18*b*, 19*b*, 18*c* and 19*c* to each other are not provided inside the track R in the electronic component 10. Therefore, since there are no conductors that would disturb the magnetic flux generated by the inductor L inside the track R, the inductance value of the inductor L can be made large in the electronic component 10.

Furthermore, a reduction in the direct-current resistance value of the inductor L is realized in the electronic component 10. In more detail, the superposed portion 30*a* and the superposed portion 20*b* are physically connected to each other. Similarly, the superposed portion 30*b* and the superposed portion 20*c* are physically connected to each other. The cross-sectional area of the inductor L in a section in which the superposed portions 30*a* and 20*b* are provided and in a section in which the superposed portions 30*b* and 20*c* are provided is the sum of the sectional areas of the two conductor layers. It is preferable that the lengths of these sections be large from the viewpoint of reducing the direct-current resistance value of the inductor L. Accordingly, the entirety of the superposed portion 30*a* and the entirety of the superposed portion 20*b* are physically connected to each other in the electronic component 10. Similarly, the entirety of the superposed portion 30*b* and the entirety of the superposed portion 20*c* are physically connected to each other. Thus, a reduction in the direct-current resistance value of the inductor L is realized.

Furthermore, a reduction in the direct-current resistance value of the inductor L is realized in the electronic component 10 due to the following reason. In more detail, the connection conductor layers 40*a* to 40*c* extend along and are superposed with the side L1 and the side L4. In other words, the connection conductor layers 40*a* to 40*c* are provided close to the back right corner of the track R. The line width in a corner is larger than the line width at the parts of the sides outside the corner. Therefore, the line widths of the connection conductor layers 40*a* to 40*c* can be increased by providing the connection conductor layers 40*a* to 40*c* close to a corner. As a result, the resistance values of the connection conductor layers 40*a* to 40*c* are reduced, and a reduction in the direct-current resistance value of the inductor L is realized.

A reduction in the direct-current resistance value of the inductor L is realized in the electronic component 10 due to the following reason. In more detail, the line widths of the connection conductor layers 40*a* to 40*c* are larger than the line widths of the superposed portions 20*a* to 20*c* and 30*a* to 30*c* of the inductor conductor layers 18*a* to 18*c* and 19*a* to 19*c*. Thus, the resistance values of the connection conductor layers 40*a* to 40*c* are reduced, and a reduction in the direct-current resistance value of the inductor L is realized.

A reduction in the direct-current resistance value of the inductor L is realized in the electronic component 10 due to the following reason. In more detail, the line widths of the non-superposed portions 22*a* to 22*c* and 32*a* to 32*c* are larger than the line widths of the superposed portions 20*a* to 20*c* and 32*a* to 32*c*. Thus, the resistance values of the inductor conductor layers 18*a* to 18*c* and 19*a* to 19*c* are reduced, and a reduction in the direct-current resistance value of the inductor L is realized.

Furthermore, a high heat dissipation property can be realized in the electronic component 10. In more detail, the connection conductor layers 40*a* to 40*c* of the inductor L have a thickness of only one layer except in the parts where the connection conductor layers 40*a* to 40*c* are connected to the non-superposed portions 22*a* to 22*c* and 32*a* to 32*c*. Therefore, the direct-current resistance values of the parts of the connection conductor layers 40*a* to 40*c* other than the parts where the connection conductor layers 40*a* to 40*c* are connected to the non-superposed portions 22*a* to 22*c* and 32*a* to 32*c* are comparatively high. Therefore, heat is readily generated in the connection conductor layers 40*a* to 40*c*. Accordingly, the connection conductor layers 40*a* to 40*c* are positioned close to the outer electrode 14*b*. As a result, the heat generated in the connection conductor layers 40*a* to 40*c* is released into the space outside the electronic component 10 via the outer electrode 14*b*. Therefore, a high heat dissipation property can be realized in the electronic component 10.

Furthermore, as described above, the connection conductor layers 40*a* to 40*c* constitute parts of the inductor L where heat is readily generated. Accordingly, the connection conductor layers 40*a* to 40*c* have a large line width. Thus, the resistance values of the connection conductor layers 40*a* to 40*c* are reduced, and the heat generated in the connection conductor layers 40*a* to 40*c* is reduced. As a result, localized heating of the electronic component 10 is suppressed.

Furthermore, an excellent direct-current superposition characteristic can be realized in the electronic component 10. In more detail, in the electronic component 10, the non-magnetic portion 17*c* is provided between the superposed portion 20*a* and the superposed portion 30*a*, the non-magnetic portion 17*f* is provided between the superposed portion 20*b* and the superposed portion 30*b*, and the non-magnetic portion 17*i* is provided between the superposed portion 20*c* and the superposed portion 30*c*. Thus, the magnetic flux density is prevented from becoming too high in the region between the superposed portion 20*a* and the superposed portion 30*a*, in the region between the superposed portion 20*b* and the superposed portion 30*b*, and in the region between the superposed portion 20*c* and the superposed portion 30*c*. As a result, the occurrence of magnetic saturation in the inductor L is suppressed, and an excellent direct-current superposition characteristic can be realized in the electronic component 10.

Furthermore, conductors for connecting the inductor conductor layers 18*a*, 19*a*, 18*b*, 19*b*, 18*c* and 19*c* to each other are not provided inside the track R in the electronic component 10. Therefore, the amount of conductive paste needed to manufacture the electronic component 10 is reduced.

The inventors of the present application performed the following experiments in order to clarify the effects exhibited by the electronic component 10. The inventors of the present application manufactured the multilayer inductor disclosed in Japanese Unexamined Patent Application Publication No. 2001-44036 as a first sample. In addition, the inventors manufactured the electronic component 10 as a second sample. At this time, conditions other than an inner diameter area were made the same in the first sample and the second sample. The term "inner diameter area" refers to the area of a region enclosed by the inductor L when viewed from above. The inductance values of the first sample and the second sample were measured. The Table illustrates the experiment conditions and the experiment results.

TABLE

| | First sample | Second sample |
|---|---|---|
| Inner diameter area ($mm^2$) | 0.153 | 0.186 |
| Distance between inductor conductor layers (μm) | 10 | 10 |
| Length of inductor (μm) | 314 | 314 |
| Thickness of insulator layers 16a and 16k (outer layers) | 83 | 83 |
| Inductance value (μH) | 5.35 | 5.82 |
| Direct-current resistance value (mΩ) | 360 | 360 |

Conductors for connecting the inductor conductor layers 18*a*, 19*a*, 18*b*, 19*b*, 18*c* and 19*c* to each other are not provided inside the track R in the second sample. Therefore, the inner diameter area of the second sample is larger than the inner diameter area of the first sample. Consequently, as illustrated in the Table, the inductance value of the second sample is larger than the inductance value of the first sample.

First Modification

Figure 7:
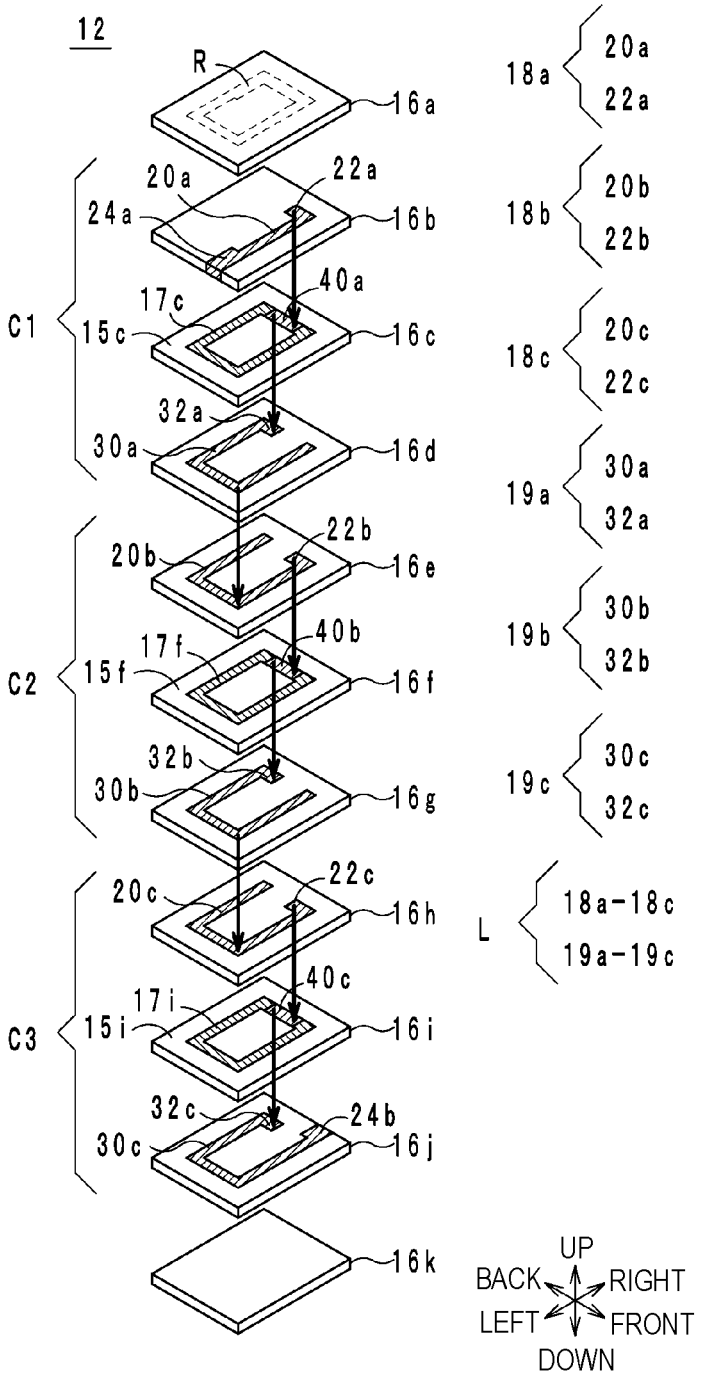
FIG. 7 is an exploded perspective view of a multilayer body of an electronic component according to a first modification.

Hereafter, an electronic component according to a first modification will be described while referring to the drawings. FIG. 7 is an exploded perspective view of a multilayer body 12 of an electronic component 10*a* according to the first modification. FIG. 1 is referred to as an external perspective view of the electronic component 10*a*.

The electronic component 10*a* differs from the electronic component 10 with respect to the positions at which connection conductor layers 40*a* to 40*c* are provided and the shapes of the connection conductor layers 40*a* to 40*c*. Hereafter, the electronic component 10*a* will be described while focusing upon these differences.

In the electronic component 10, the connection conductor layers 40*a* to 40*c* are provided close to the back right corner of the track R, and are substantially L-shaped when viewed from above. In contrast, in the electronic component 10*a*, the connection conductor layers 40*a* to 40*c* are superposed with the right side L4 of the track R, and are substantially straight line shaped when viewed from above. In the electronic component 10*a*, the connection conductor layers 40*a* to 40*c* are superposed with the side L4 (example of any one prescribed side among first long side, second long side, first short side and second short side) and is not superposed with the remaining sides L1 to L3 when viewed from above. In addition, the connection conductor layers 40*a* to 40*c* are shorter than the side L4.

Furthermore, when viewed from above, the side L4 is the side that is closest to the right surface (first lateral surface) of the multilayer body 12 among the sides L1 to L4 of the track R and is parallel to the right surface. The outer electrode 14*b* covers the right surface of the multilayer body 12. Thus, the connection conductor layers 40*a* to 40*c* are close to the outer electrode 14*b*.

Similarly as in the electronic component 10, a larger inductance value can be obtained with the thus-configured electronic component 10*a* as well. In addition, similarly as in the electronic component 10, a reduction in the direct-current resistance value of the inductor L is realized in the electronic component 10*a* as well. Furthermore, similarly as in the electronic component 10, an excellent direct-current superposition characteristic can be obtained in the electronic component 10*a* as well. According to the electronic component 10*a*, the amount of conductive paste needed to manufacture the electronic component 10*a* is reduced, similarly as in the case of the electronic component 10.

Furthermore, a higher heat dissipation property can be realized in the electronic component 10*a*. In more detail, in the electronic component 10*a*, the entirety of each of the connection conductor layers 40*a* to 40*c* are superposed with the side L4 when viewed from above. In contrast, in the electronic component 10, only around half of each of the connection conductor layers 40*a* to 40*c* is superposed with the side L4 when viewed from above. Therefore, the length of the part of each of the connection conductor layers 40*a* to 40*c* that is located close to the outer electrode 14*b* is larger in the electronic component 10*a* than in the electronic component 10. As a result, a higher heat dissipation property can be realized in the electronic component 10*a*.

Furthermore, a reduction in the direct-current resistance value of the inductor L is realized in the electronic component 10*a* due to the following reason. In more detail, the resistance value is likely to be high in the connection conductor layers 40*a* to 40*c*. Therefore, in the electronic component 10*a*, the connection conductor layers 40*a* to 40*c* are shorter than the side L4. Thus, since the length of parts in which the resistance value is likely to be high are short, a reduction in the direct-current resistance value of the inductor L is realized in the electronic component 10*a*.

Second Modification

Figure 8A:
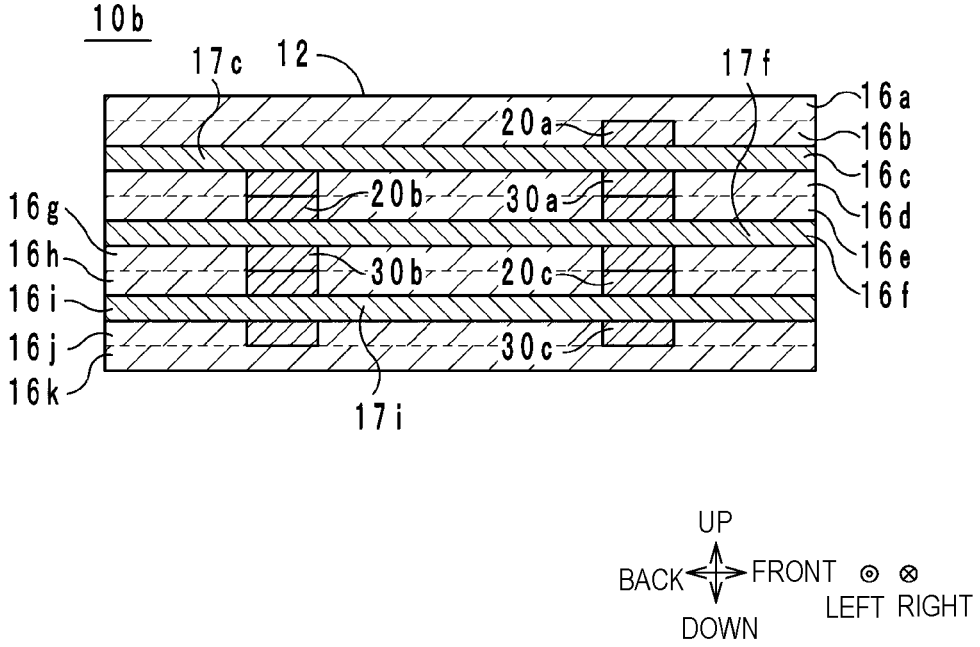
FIG. 8A is a sectional structural view of a multilayer body of an electronic component according to a second modification.

Hereafter, an electronic component according to a second modification will be described while referring to the drawings. FIG. 8A is a sectional structural view of a multilayer body 12 of an electronic component 10*b* according to the second modification. FIG. 1 is referred to as an external perspective view of the electronic component 10*b*. FIG. 8A is a sectional structural view taken along line 1-1 in FIG. 1.

The electronic component 10*b* differs from the electronic component 10 in that the entirety of each of the insulator layers 16*c*, 16*f* and 16*i* is constituted by a non-magnetic portion. Thus, the positions and sizes of the non-magnetic portions are not limited to those illustrated in the electronic component 10.

Third Modification

Figure 8B:
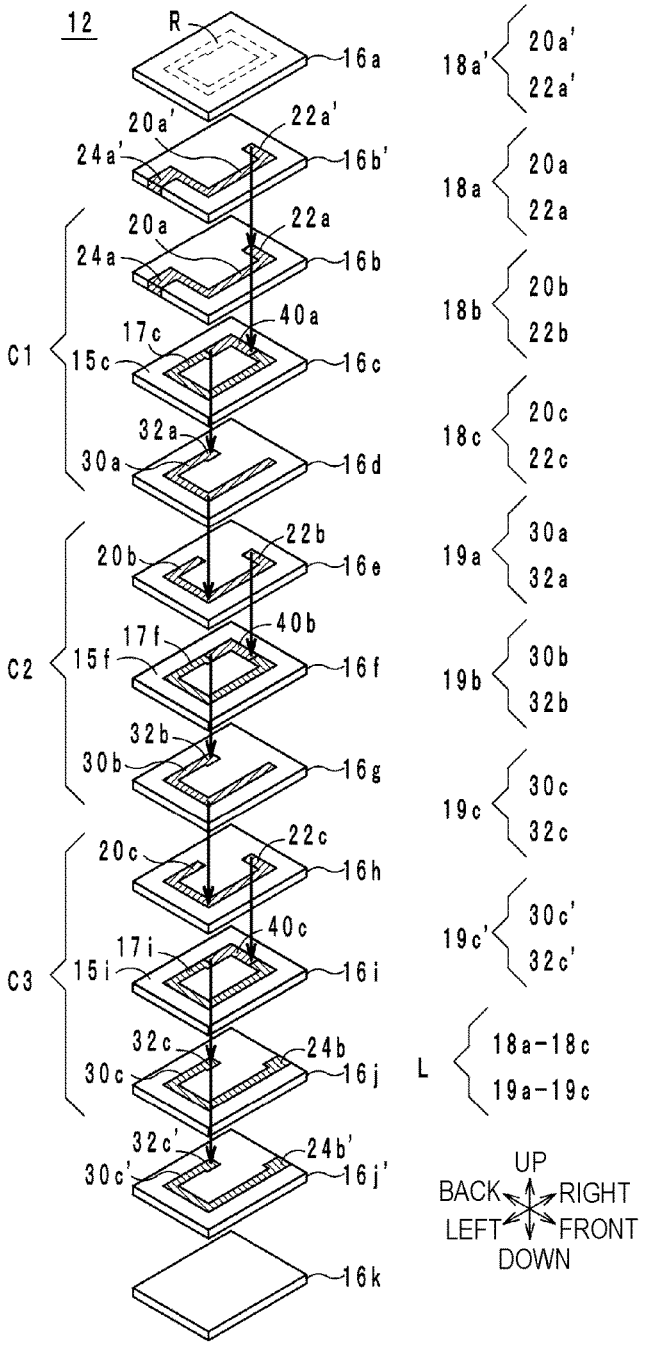
FIG. 8B is a sectional structural view of a multilayer body of an electronic component according to a third modification.
Figure 9:
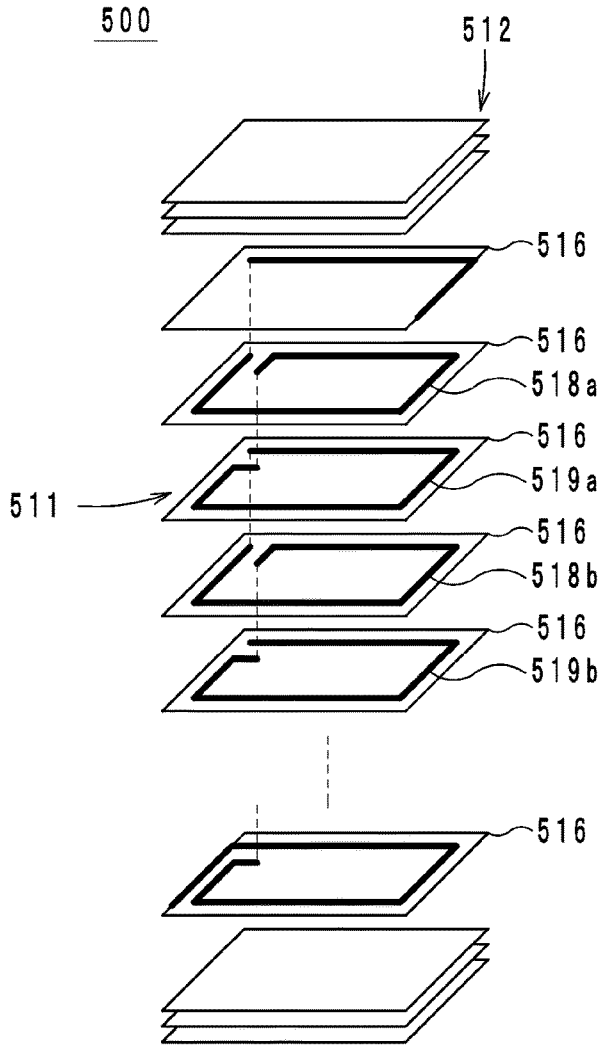
FIG. 9 is an exploded perspective view of a multilayer inductor disclosed in the above-cited patent document.

Hereafter, an electronic component according to a third modification will be described while referring to the drawings. FIG. 8B is an exploded perspective view of a multilayer body 12 of an electronic component 10*c* according to the third modification. FIG. 1 is referred to as an external perspective view of the electronic component 10*c*.

The electronic component 10*c* differs from the electronic component 10 in that the electronic component 10*c* further includes insulator layers 16*b*' and 16*j*', inductor conductor layers 18*a*' and 19*c*' and leading out conductor layers 24*a*' and 24*b*'. Hereafter, the electronic component 10*c* will be described while focusing upon these differences.

The insulator layers 16*b*' and 16*j*' respectively have the same shapes as the insulator layers 16*b* and 16*j*. Furthermore, the insulator layer 16*b*' is provided between the insulator layer 16*a* and the insulator layer 16*b*. The insulator layer 16*j*' is provided between the insulator layer 16*j* and the insulator layer 16*k*.

The inductor conductor layers 18*a*' and 19*c*' respectively have the same shapes as the inductor conductor layers 18*a* and 19*c*. The inductor conductor layers 18*a*' and 19*c*' are respectively provided at the same positions as the insulator layers 16*b*' and 16*j*' in the up-down direction. Furthermore, the leading out conductor layers 24*a*' and 24*b*' respectively have the same shapes as the leading out conductor layers 24*a* and 24*b*. In addition, the leading out conductor layers 24*a*' and 24*b*' are respectively provided at the same positions as the insulator layers 16*b*' and 16*j*' in the up-down direction.

As described above, a group consisting of the insulator layer 16*b*, the inductor conductor layer 18*a* and the leading out conductor layer 24*a*, and a group consisting of the insulator layer 16*b*', the inductor conductor layer 18*a*' and the leading out conductor layer 24*a*' are stacked adjacent to each other in the up-down direction. In addition, these groups have the same structure as each other. Similarly, a group consisting of the insulator layer 16*j*, the inductor conductor layer 19*c* and the leading out conductor layer 24*b*, and a group consisting of the insulator layer 16*j*', the inductor conductor layer 19*c*' and the leading out conductor layer 24*b*' are stacked adjacent to each other in the up-down direction. In addition, these groups have the same structure as each other. The rest of the configuration of the electronic component 10*c* is the same as that of the electronic component 10 and therefore description thereof is omitted.

According to the thus-configured electronic component 10*c*, a larger inductance value than was previously possible can be obtained for the same reasons as in the electronic component 10. In addition, a reduction in the direct-current resistance value of the inductor L is realized in the electronic component 10*c* for the same reason as in the electronic component 10. Furthermore, a high heat dissipation property can be realized in the electronic component 10*c* for the same reason as in the electronic component 10. In addition, an excellent direct-current superposition characteristic can be obtained in the electronic component 10*c* for the same reason as in the electronic component 10. Furthermore, the amount of conductive paste needed to manufacture the electronic component 10*c* is reduced in the electronic component 10*c* for the same reason as in the electronic component 10.

Other Embodiments

Electronic components according to embodiments of the present disclosure are not limited to the electronic components 10, and 10*a* to 10*c* and may be changed within the scope of the spirit of the present disclosure.

The configurations of the electronic components 10 and 10*a* to 10*c* may be combined with each other, as appropriate.

Furthermore, although the entirety of the superposed portion 30*a* and the entirety of the superposed portion 20*b* are physically connected to each other in the electronic components 10 and 10*a* to 10*c*, it would be sufficient for at least part of the superposed portion 30*a* and at least part of the superposed portion 20*b* to be physically connected to each other. Similarly, although the entirety of the superposed portion 30*b* and the entirety of the superposed portion 20*c* are physically connected to each other, it would be sufficient for at least part of the superposed portion 30*b* and at least part of the superposed portion 20*c* to be physically connected to each other.

In addition, in the electronic components 10 and 10*a* to 10*c*, the inductor conductor layer 19*a* and the insulator layer 16*d* may be arranged across two layers in the up-down direction. In this case, the upper inductor conductor layer 19*a* is a second inductor conductor layer. The superposed portion 30*a* of the upper inductor conductor layer 19*a* is connected to the superposed portion 20*b* of the inductor conductor layer 18*b* via the superposed portion 30*a* of the lower inductor conductor layer 19*a*. In addition, similarly to the inductor conductor layer 19*a*, the inductor conductor layers 18*a* to 18*c*, 19*b* and 19*c* may be similarly arranged across two layers in the up-down direction. Thus, the direct-current resistance value of the inductor L is reduced.

In addition, in the electronic components 10 and 10*b*, the connection conductor layers 40*a* to 40*c* may be provided at the front right corner, the front left corner or the back left corner of the track R when viewed from above.

Furthermore, in the electronic component 10*a*, the connection conductor layers 40*a* to 40*c* may be superposed with any one of the sides L1 to L3 of the track R when viewed from above.

In addition, the track R may have a shape other than a rectangular shape, and for example, may have an elliptical or circular shape when viewed from above. Furthermore, the rectangular shape is a concept that includes a square shape.

As described above, the present disclosure is of use in electronic components, and is particularly excellent in that the present disclosure enables a larger inductance value than was previously possible to be realized.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. An electronic component comprising:

a multilayer body having a structure obtained by stacking a plurality of insulator layers including first insulator layers on top of one another in a stacking direction; and an inductor that is provided in the multilayer body;

wherein the inductor includes a plurality of first inductor conductor layers, a plurality of second inductor conductor layers and a plurality of connection conductor layers that are superposed with each other when viewed in the stacking direction and thereby form an annular track, the first inductor conductor layers, when viewed in the stacking direction, each include a first superposed portion that is superposed with the second inductor conductor layers, and each include a first non-superposed portion that protrudes from the second inductor conductor layers toward a downstream side when turning in a prescribed direction, the second inductor conductor layers are each provided closer to one side in the stacking direction than a corresponding one of the first inductor conductor layers, and, when viewed in the stacking direction, each include a second superposed portion that is superposed with the first inductor conductor layers and each include a second non-superposed portion that protrudes from the first inductor conductor layers toward an upstream side when turning in the prescribed direction, a plurality of groups are arrayed in the stacking direction, each group consisting of a corresponding one of the first inductor conductor layers, a corresponding one of the second inductor conductor layers, a corresponding one of the connection conductor layers and a corresponding one of the first insulator layers, in each group, the first insulator layer is provided between the first superposed portion of the first inductor conductor layer and the second superposed portion of the second inductor conductor layer included in the same group, in each group, the connection conductor layer is provided at the same position as the first insulator layer in the stacking direction, and electrically connects the first non-superposed portion of the first inductor conductor layer and the second non-superposed portion of the second inductor conductor layer included in the same group to each other, and at least part of the second superposed portion of the second inductor conductor layer included in a group located on another side in the stacking direction among two groups that are adjacent to each other in the stacking direction and at least part of the first superposed portion of the first inductor conductor layer included in a group located on the one side in the stacking direction among the two groups that are adjacent to each other in the stacking direction are physically connected to each other or are connected to each other via a conductor.

2. The electronic component according to claim 1, wherein the entirety of the second superposed portion of the second inductor conductor layer included in the group located on the other side in the stacking direction among the two groups that are adjacent to each other in the stacking direction and the entirety of the first superposed portion of the first inductor conductor layer included in the group located on the one side in the stacking direction among the two groups that are adjacent to each other in the stacking direction are physically connected to each other or are connected to each other via a conductor.

3. The electronic component according to claim 1, wherein at least part of the second superposed portion of the second inductor conductor layer included in the group located on the other side in the stacking direction among the two groups that are adjacent to each other in the stacking direction and at least part of the first superposed portion of the first inductor conductor layer included in the group located on the one side in the stacking direction among the two groups that are adjacent to each other in the stacking direction are physically connected to each other.

4. The electronic component according to claim 1, wherein the annular track has a substantially rectangular shape having a first long side, a second long side, a first short side and a second short side when viewed in the stacking direction, and the connection conductor layers extend along and are superposed with the first long side and the first short side and are not superposed with the second long side and the second short side when viewed in the stacking direction.

5. The electronic component according to claim 1, wherein the annular track has a substantially rectangular shape having a first long side, a second long side, a first short side and a second short side when viewed in the stacking direction, and the connection conductor layers are superposed with any one prescribed side among the first long side, the second long side, the first short side and the second short side, and are not superposed with the remaining sides when viewed in the stacking direction.

6. The electronic component according to claims 5, wherein the multilayer body has a substantially rectangular parallelepiped shape having a first lateral surface that is parallel to the stacking direction, the sides of the annular track are parallel to outer edges of the multilayer body when viewed in the stacking direction, the electronic component further comprising:

an outer electrode that is electrically connected to the inductor and is provided on the first lateral surface;

wherein the prescribed side is the side closest to the first lateral surface among the sides of the annular track, and the prescribed side is parallel to the first lateral surface when viewed in the stacking direction.

7. The electronic component according to claim 5, wherein the connection conductor layers are superposed with the first short side, and are shorter than the first short side.

8. The electronic component according to claim 1, wherein a line width of the connection conductor layers is larger than a line width of the first superposed portions and a line width of the second superposed portions.

9. The electronic component according to claim 1, wherein a line width of the first non-superposed portions and a line width of the second non-superposed portions are larger than a line width of the first superposed portions and a line width of the second superposed portions.

* * * * *